United States Patent [19]

Lubbers

[11] 4,349,150

[45] Sep. 14, 1982

[54] CONCRETE SLEEPER WITH THE FASTENING HOUSING

[75] Inventor: Marius H. Lubbers, Wassenaar, Netherlands

[73] Assignee: Everts & Van der Weyden Exploitatiemaatschappij, The Hague, Netherlands

[21] Appl. No.: 142,980

[22] Filed: Apr. 23, 1980

[30] Foreign Application Priority Data

May 7, 1979 [NL] Netherlands ..... 7903569

[51] Int. Cl.[3] ..... E01B 2/00; E01B 9/00; E01B 9/40

[52] U.S. Cl. ..... 238/265; 238/91; 238/107; 238/264; 238/287

[58] Field of Search ..... 238/91, 92, 94, 106, 238/107, 115, 116, 265, 270, 287, 264, 283, 312

[56] References Cited

U.S. PATENT DOCUMENTS

| | | | |
|---|---|---|---|
| 1,071,361 | 8/1913 | Sisk | 238/91 |
| 1,423,600 | 7/1922 | Crane | 238/91 |
| 3,565,336 | 2/1971 | Eisses | 238/265 |
| 3,834,620 | 9/1974 | Barlett | 238/265 |
| 4,061,270 | 12/1977 | Wandrisco | 238/107 |

*Primary Examiner*—Richard A. Bertsch
*Attorney, Agent, or Firm*—Diller, Ramik & Wight

[57] ABSTRACT

A fastening housing for a rail clamp comprising a carrier plate and a superstructure having cavities for accommodating an end part and a rail clamp, said carrier plate having substantially vertically directed anchoring members extending in a concrete sleeper wherein the housing is made from synthetic resin.

8 Claims, 5 Drawing Figures

CONCRETE SLEEPER WITH THE FASTENING HOUSING

The invention relates to a fastening housing for a rail clamp comprising a carrier plate and a superstructure having cavities for accommodating an end portion of a rail clamp, said carrier plate having substantially vertically directed anchoring members extending in a concrete sleeper and to a method of manufacturing a fastening housing embedded in a concrete sleeper.

Such a fastening housing is made from cast iron. In order to electrically insulate the two rails of a railway from one another with regard to signalling pulses and the like the cast iron housing has to be insulated from the reinforcing rods in the concrete. This is achieved by embedding the anchoring members with the interposition of electrically insulating material in the concrete. A disadvantage thereof is that often a large number of component parts is required. A further disadvantage resides in that in the event of damage of the electrically insulating material electric interference currents may flow via the reinforcement of the concrete from one rail to the other.

The object of the invention is to obviate these disadvantages. According to the invention this is achieved by making the housing from synthetic resin. Since synthetic resin is electrically insulating, the arrangement of special, electrically insulating material can be dispensed with. This means saving material. Since no additional steps have any longer to be taken for the electric insulation, a greater freedom is obtained in choosing the shape of the fastening housing because enveloping parts of electrically insulating material can be omitted. The shape of the fastening housing can be chosen so that despite the light structure optimum adhesion to the concrete is obtained.

This may be achieved by providing the anchoring members with a transverse plate. The transverse plate ensures a very satisfactory fixation of the housing with respect to the concrete sleeper. This is in particular important with regard to vertical, varying loads frequently occurring in practice. The arrangement of a transverse plate at the conventional cast iron housing was hardly feasible, since it is difficult to accommodate an anchorage built of vertically directed elements and an anchoring plate transverse thereof in a similarly formed member of electrically insulating material.

A further improved fixation is obtained when the anchoring members have the shape of an apertured plate. In this case the reinforcement of the concrete can be passed through the openings. The housing may have cavities for receiving clamps on both sides of the rail. In this case one housing per rail will be sufficient.

The advantages of the fastening housing according to the invention become particularly manifest in the manufacture of a concrete sleeper with the fastening housing.

In the method according to the invention the fastening housing is arranged in the mould with the carrier plate directed downwards, the reinforcement of the concrete is passed through the openings in the anchoring plate or inserted between two anchoring members and finally the concrete is poured, after which the sleeper together with the fastening housing can be released from the mould.

The invention will be described more fully with reference to the drawings.

Figure 1:
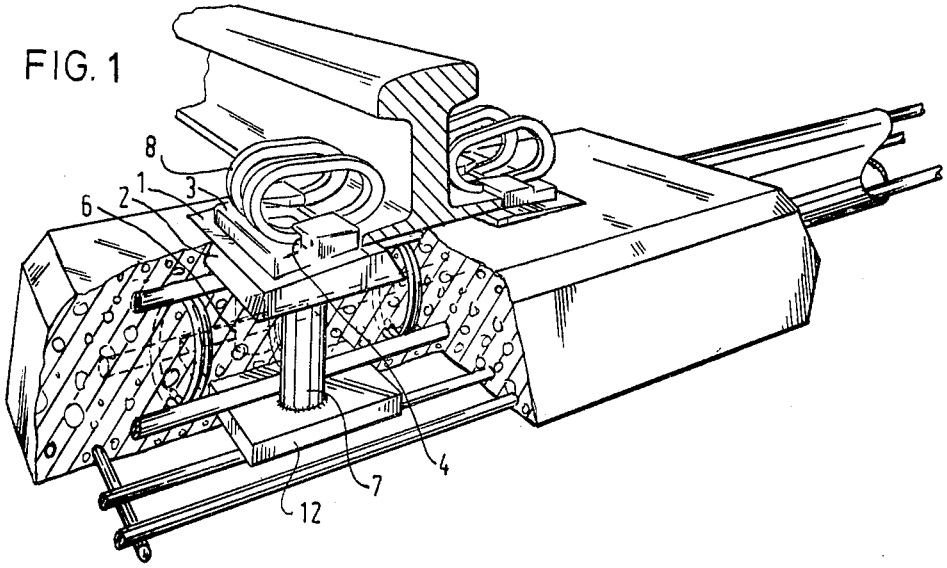
FIG. 1 is a perspective view of a concrete sleeper, a fastening housing in accordance with the invention and a rail fastened with the aid of rail clamps, some parts being omitted.
Figure 2:
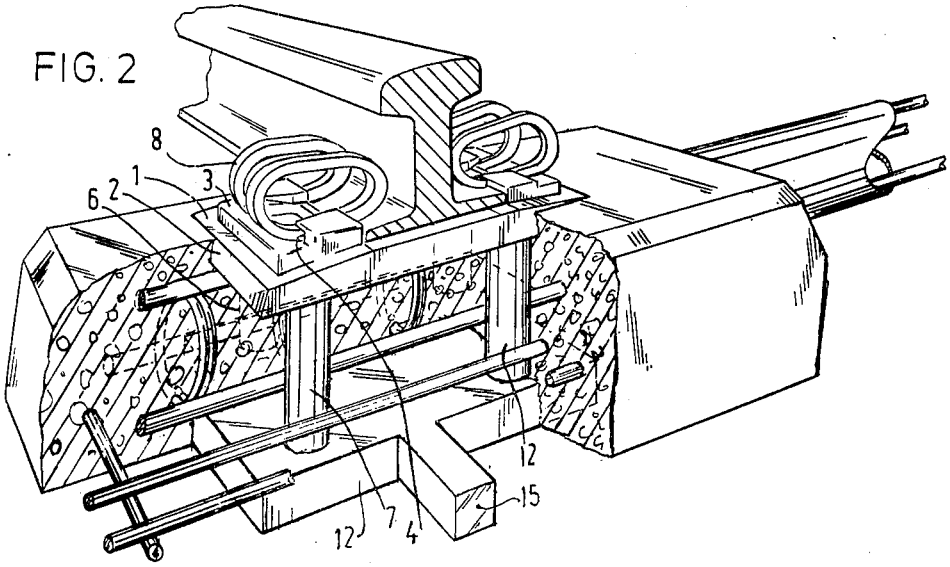
FIG. 2 shows an embodiment in which the housing is doubled.
Figure 4:
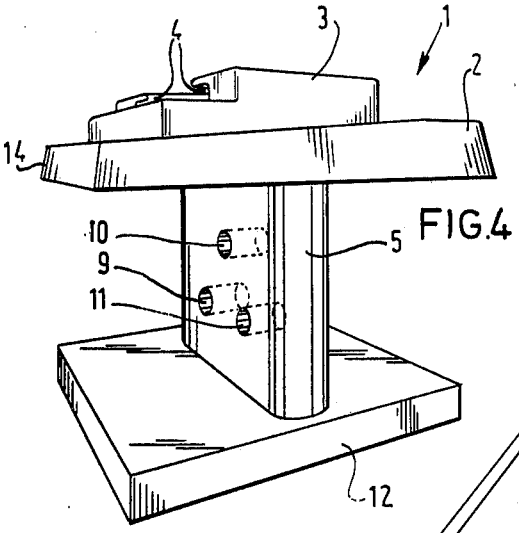
FIG. 4 is a perspective view of an embodiment of the fastening housing in accordance with the invention.

The fastening housing 1 according to the invention comprises a carrier plate 2, on which a superstructure 3 is arranged. The superstructure has cavities 4 for accommodating a rail clamp, for example, 8. The carrier plate has substantially vertically extending anchoring members in the form of, for example, a plate 5 (see FIG. 4) or rods 6 and 7 (see FIGS. 1 to 3) extending in the concrete sleeper. The anchoring plate has openings 9,10,11 through which reinforcing rods can be passed so that a very satisfying fixation of the fastening housing in the concrete is obtained. At their ends the anchoring members have a transverse plate 12, which provides a satisfactory fixation in the concrete against vertical, variable loads. The housing may be a single (see FIG. 1) or a double structure (see FIG. 2). In the embodiment shown in FIG. 1 one housing is arranged on each side of the rail, whereas in the double embodiment of FIG. 2 one housing per rail is sufficient. The fastening housings shown in the accompanying drawings are made from synthetic resin and electrically insulating. Therefore, it is allowed to arrange the reinforcement of the concrete in intimate contact with the fastening housing, which is not allowed in the case of cast iron housings. The reinforcement may be employed for improving the fixation of the housing.

Figure 3:
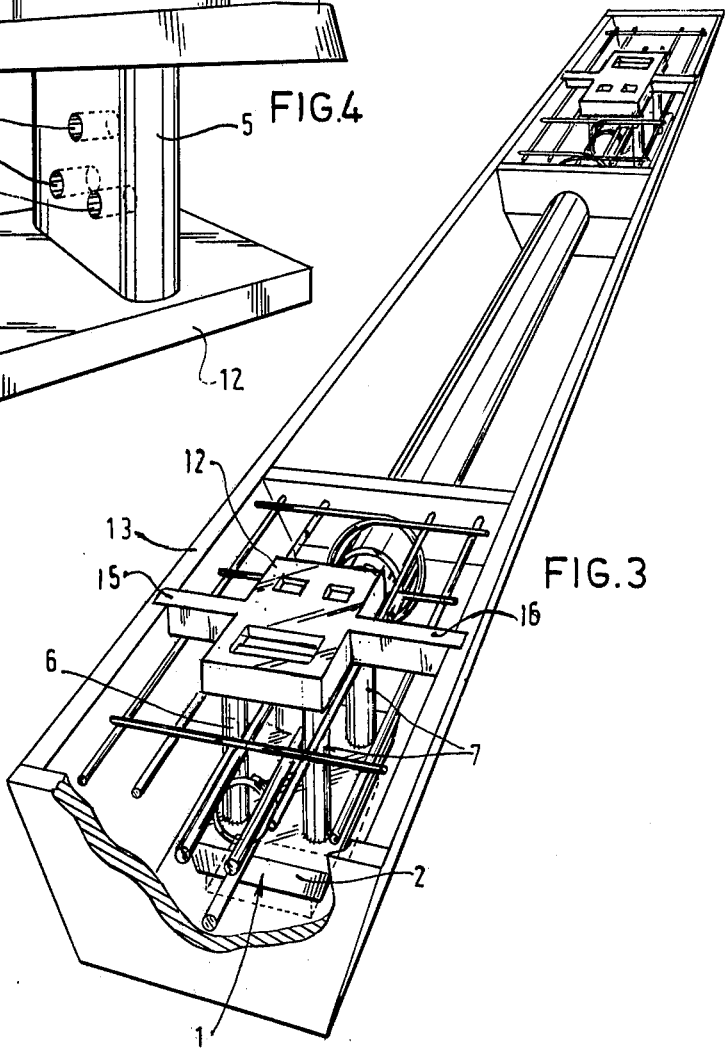
FIG. 3 illustrates the method of manufacturing a concrete sleeper with a fastening housing in accordance with the invention.

FIG. 3 illustrates the method of manufacturing a concrete sleeper with a housing according to the invention. First the synthetic resin housing is arranged in the mould 13. The bottom of the mould has a recess for the superstructure 3 and at least part of the carrier plate 2. Then the reinforcement for the concrete is passed in between two anchoring members or through the openings in the anchoring plate. Subsequently the mould 13 is filled with concrete. After curing the sleeper with the housing is released from the mould, which is facilitated by the bevelled part 14 of the carrier plate 2.

Figure 5:
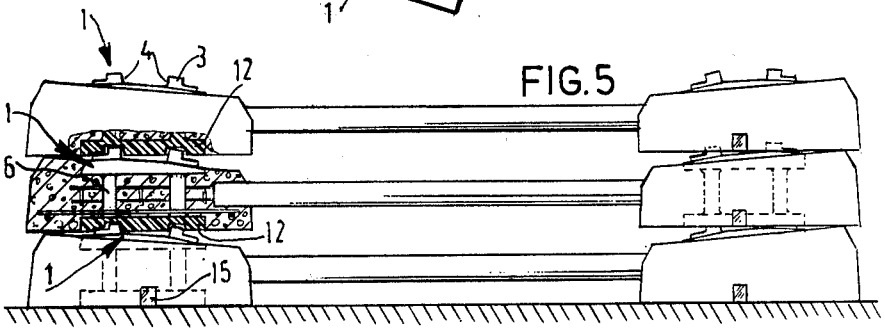
FIG. 5 illustrates a mode of stacking the concrete sleepers with the housing in accordance with the invention.

The transverse plate 12 has a recess in order to provide a space for accommodating part of the housing of a subjacent sleeper for stacking the sleepers during transport (see FIG. 5).

With this mode of stacking damage of the part of the housing projecting above the sleeper is avoided. The transverse plate 12 may furthermore have extensions 15 and 16 snapping into recesses 17 and 18 respectively in the mould wall. In this way a satisfactory fixation is obtained when the concrete is poured in.

I claim:

1. In a railway sleeper assembly which comprises a concrete sleeper having longitudinally extending metallic reinforcing rods and a pair of fastening housings adjacent the opposite ends of the sleepers for supporting rails in spaced apart, anchored conditions, the improvement wherein each fastening housing comprises a carrier plate portion partially embedded in the concrete and presenting an exposed upper surface supporting a respective rail and having recesses receiving rail clamps to secure the respective rail in place, said fastening housing being formed of synthetic resinous material whereby said rails are electrically insulated from each other, the synthetic resinous material of the fastening housing reacting under stress not only to support the rail and any load thereon but also to anchor the rail clamp, vertically extending anchoring means integral with and depending from carrier plate portion within the concrete for maintaining said fastening housing in fixed relation to said sleeper, and means cooperating with said anchoring means and with said reinforcing rods to enhance the fixation of said fastening housings to the sleeper and to tie the opposite ends of said sleeper to each other.

2. In a railway sleeper assembly as defined in claim 1 wherein said means last mentioned comprise openings in said vertically extending anchoring means and through which said reinforcing means pass.

3. In a railway sleeper assembly as defined in claim 1 wherein said means comprise a transverse plate portion integral with said vertically extending anchoring means and disposed in vertically spaced relation therebelow to define a concrete-receiving space through which said reinforcing rods extend.

4. In a railway sleeper assembly as defined in claim 1, 2 or 3 wherein each carrier plate portion is provided with upwardly, inwardly sloping circumferential edges embedded in the concrete.

5. In a railway sleeper as defined in claim 3 wherein each transverse plate portion includes a bottom surface substantially flush with the bottom face of the concrete sleeper, said bottom surface being provided with recesses to facilitate stacking of the sleeper assembly during storage.

6. In a railway sleeper assembly as defined in claim 5 wherein each transverse plate portion is provided with opposite side extensions to facilitate suspension of each fastening housing within a mold incidental to forming the sleeper assembly.

7. A railway tie construction comprising, in combination:

a pair of fastening housings made of synthetic resin and disposed in spaced apart relation, each housing including a superstructure defining at least one upstanding portion abutting against a rail flange and presenting a cavity receiving an end portion of a rail clamp and each superstructure presenting a rail flange supporting surface adjacent such upstanding portions upon which the flange of a rail bears, the synthetic resin forming the upstanding portion and the rail flange supporting surface reacting under stress not only to support the rail and any load thereon but also to anchor the rail clamp;

a concrete mass surrounding each fastening housing to a level at the base of the superstructure; and reinforcing rod means extending between and joining the concrete masses surrounding said fastening housings.

8. A railway tie construction as defined in claim 7 wherein each synthetic resin fastening housing also includes an integral carrier plate upon which the associated superstructure is arranged, an integral transverse plate disposed in spaced relation below said carrier plate and at least one vertically extending anchoring member integrally joining said carrier plate to said transverse plate.

* * * * *